United States Patent [19]

Podszün et al.

[11] Patent Number: 4,639,403

[45] Date of Patent: Jan. 27, 1987

[54] ELECTROSTATOGRAPHIC SUSPENSION DEVELOPER AND A PROCESS FOR ITS PREPARATION COMPRISING QUATERNARY IONIC COPOLYMER FOR POSITIVE TONER CHARGE

[75] Inventors: Wolfgang Podszün; John Goossens, both of Cologne; Carlhans Süling, Odenthal; Günther Hoffarth, Leverkusen; Wolfgang Richter, Krefeld, all of Fed. Rep. of Germany; Herman Uytterhoeven, Bonheiden; Walter de Winter, Grafenwezen, both of Belgium

[73] Assignee: Agfa Gevaert Aktiengesellschaft, Leverkusen, Fed. Rep. of Germany

[21] Appl. No.: 752,095

[22] Filed: Jul. 5, 1985

[30] Foreign Application Priority Data

Jul. 17, 1984 [DE] Fed. Rep. of Germany ..... 3426256

[51] Int. Cl.[4] ..... G03G 9/12

[52] U.S. Cl. ..... 430/115; 430/904

[58] Field of Search ..... 430/113, 114, 904, 115

[56] References Cited

U.S. PATENT DOCUMENTS 3,977,983 8/1976 Tsuneda ..... 430/115

*Primary Examiner*—John D. Welsh

*Attorney, Agent, or Firm*—Connolly and Hutz

[57] ABSTRACT

An electrostatographic suspension developer contains a dispersed pigment and a copolymer of A. cationic monomers which contain ammonium, phosphonium or sulfonium groups and of which the anions are derived from CH-acidic or sulfur- or phosphorus-containing acidic compounds containing at least one $C_6$–$C_{24}$ hydrocarbon radical and B. radically polymerizable, olefinically unsaturated compounds as comonomers in an electrically insulating carrier liquid having a volume resistivity of at least $10^9$ ohm. cm and a dielectric constant below 3.

7 Claims, No Drawings

ELECTROSTATOGRAPHIC SUSPENSION DEVELOPER AND A PROCESS FOR ITS PREPARATION COMPRISING QUATERNARY IONIC COPOLYMER FOR POSITIVE TONER CHARGE

This invention relates to an improved electrostatographic suspension developer containing an ionic copolymer to produce a positive toner charge and to a process for producing this developer.

Electrostatic images on electrostatographic recording materials can be developed by wet and dry developing processes. The wet developing processes which use suspension developers are superior to the dry developing processes in regard to edge definition and resolving power.

Suspension developers generally consist of a highly insulating carrier liquid, a pigment, a charge control agent and a polymer. The carrier liquid preferably has a volume resistivity of at least $10^9$ ohm.cm and a dielectric constant below 3. The pigments used are, for example, standard azo dyes, xanthene dyes, phthalocyanine dyes, of the type described inter alia in DE-A No. 29 44 021, and also triphenylmethane dyes, acridine dyes or quinoline dyes. The black pigments used are preferably carbon black pigments.

The function of the polymer is primarily to impart adequate steric stabilization to the pigment dispersion and to guarantee adhesion or fixing of the pigment particles to the image carrier.

Numerous polymers of different structure may be used as a component of electrostatographic suspension developers. Thus, the use of statistical copolymers synthesized from weakly polar monomers (for example $C_6$–$C_{20}$ alkyl(meth)acrylate) and more strongly polar monomers (for example aminomethacrylates or vinyl pyrrolidone), has been repeatedly described (cf. for example DE-A No. 19 27 592, DE-A No. 19 38 001, BE-A No. 784 367, JP-A No. 49 129 539 or JP-A No. 73 431 54). It is also possible to use styrene-butadiene copolymers (cf. for example DE-A No. 23 37 419, DE-A No. 24 52 499 or JP-A No. 73 290 72).

Various graft copolymers have also been used in the synthesis of suspension developers (cf. for example DE-A No. 20 42 804, DE-A No. 21 03 045, DE-A No. 24 21 037, DE-A No. 25 32 281, DE-A No. 24 32 288, DE-A No. 29 35 287, GB-A No. 2 157 234, GB-A No. 2 029 049 or U.S. Pat. No. 4 033 890).

It is known from DE-OS No. 32 32 062 that the pigment particles of a suspension developer can be sterically stabilized by forming a crosslinked polymer shell by precipitation polymerization.

Where the polymers contain ionic groups, these groups can play a part in the production of the toner charge. In general, however, the toner particles are charged by oilsoluble ionic compounds, for example by metal salts of organic acids containing long aliphatic groups. Thus, carbon black pigments for example can be positively charged in liquid isoparaffin by organic phosphorus compounds (GB-A No. 1 151 141). A negative charge can be built up by the addition of basic metal alkyl sulfonates (GB-A No. 1 571 401).

The disadvantage of using the known charge control agents is that the electrical properties of the liquid developer, such as conductivity and particle charge, are not stable to changes in concentration and are seriously affected by traces of water (for example atmospheric moisture). In addition, liquid developers of the type in question generally show high electrical conductivity of the dispersion medium, thereby adversely affecting the electrophoretic deposition of the toner particles.

The object of the present invention is to provide an electrostatographic suspension developer characterized by a positive toner charge, by high charge stability and by low conductivity of the dispersion medium.

According to the invention, this object is achieved by a suspension developer containing a dispersed pigment and at least one copolymer in an electrically insulating carrier liquid having a volume resistivity of at least $10^9$ ohm.cm and a dielectric constant below 3, characterized in that the copolymer is formed from A. cationic monomers which contain ammonium, phosphonium or sulfonium groups and of which the anions are derived from CH-acidic or sulfur- or phosphorus-containing acidic compounds containing at least one $C_6$–$C_{24}$ hydrocarbon radical and B. radically polymerizable, olefinically unsaturated compounds as comonomers.

Hydrocarbons, fluorinated hydrocarbons or silicone oils may be used as the carrier liquid having a volume resistivity of at least $10^9$ ohm.cm and a dielectric constant below 3. Preferred carrier liquids are hydrocarbon-based liquids, for example aromatic hydrocarbons, such as benzene, toluene or xylenes, or aliphatic $C_6$–$C_{15}$ hydrocarbons, such as n-hexane, cyclohexane, n-heptane, n-octane or decalin. Mixtures of different hydrocarbons may also be used. Branched aliphatic hydrocarbons, such as isodecane and isododecane, are particularly suitable.

Suitable pigments are the above-mentioned black and colored pigments which are normally used for suspension developers. Particularly suitable pigments are, for example, Spiritschwarz (C.I. No. 50415), Anilinschwarz (C.I. No. 50440), Cyaninblau (C.I. No. 74250), Brillant Carmine 6 B (C.I. No. 15850), Echtrot (C.I. No. 15865), Bezidinorange (C.I. 21110) or Permanentgelb GR 52 (C.I. 21100). Particularly preferred pigments are carbon black (above all basic types), Helioechtblau HG (C.I. No. 74160), Fanalrosa B (C.I. No. 45160) and Helioechtgelb GRN (C.I. No. 21100).

The copolymer contains from 0.1 to 80% by weight, preferably from 0.5 to 50% by weight and, more preferably, from 2 to 20% by weight of polymerized cationic monomers (A).

The cation of the ionic monomers (A) preferably corresponds to one of the following formulae:

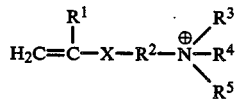

I

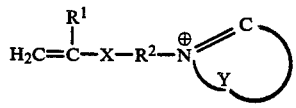

II

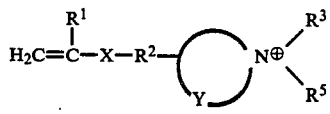

III

-continued

IV

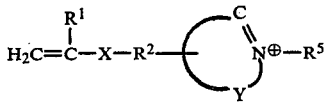

V

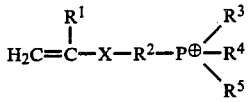

VI

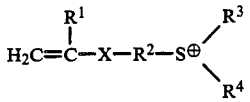

in which $R^1$ is a hydrogen atom or a $CH_3$ group, $R^2$ is a $C_1$–$C_{18}$ hydrocarbon radical, $R^3$ and $R^4$ may be the same or different and represent a $C_1$–$C_{18}$ hydrocarbon radical or together form a 5-membered or 6-membered ring, $R^5$ is a hydrogen atom or a $C_1$–$C_{18}$ hydrocarbon radical X is one of the following groups

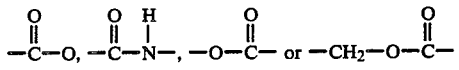

and

Y represents the atoms required to complete a 5-membered or 6-membered heterocyclic ring.

The above-mentioned hydrocarbon radicals may be linear or branched alkyl, aryl, arylalkyl or alkylaryl radicals.

The following are examples of suitable cations:

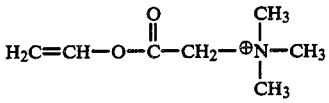

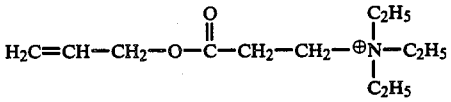

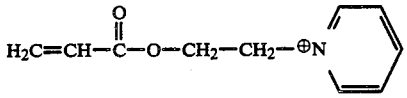

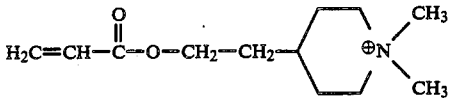

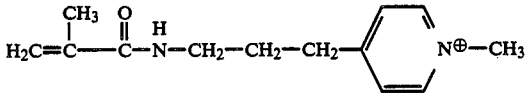

-continued

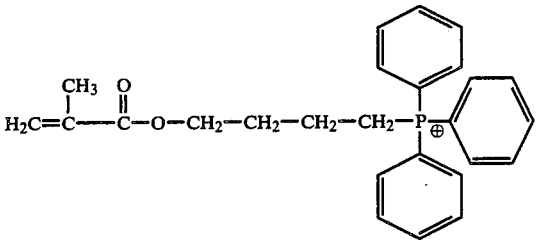

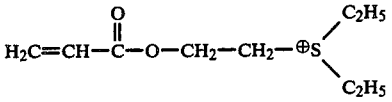

Particularly preferred cations are derivatives of acrylic acid and methacrylic acid corresponding to formulae VII and VIII:

VII

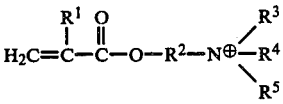

VIII

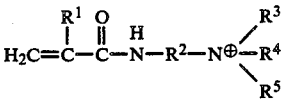

in which $R^1$, $R^2$, $R^3$, $R^4$ and $R^5$ are as defined above.

Suitable anions of the ionic monomers (A) are anions derived from CH-acidic or sulfur- or phosphorus-containing acidic compounds containing at least one $C_6$–$C_{24}$ hydrocarbon radical.

Anions in which branched hydrocarbon radicals are present are particularly suitable.

Suitable anions correspond to the following general formulae:

$Z\text{-}R^6$ and $Z\text{-}OR^6$ in which

Z is one of the groups $-SO_3^{\ominus}$ or

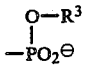

and $R^3$ is a $C_1$–$C_{18}$ hydrocarbon radical, $R^6$ is a $C_6$–$C_{24}$ hydrocarbon radical.

The following compounds corresponding to the above general formulae are mentioned as examples:

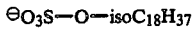

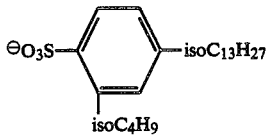

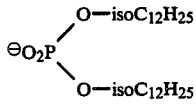

-continued

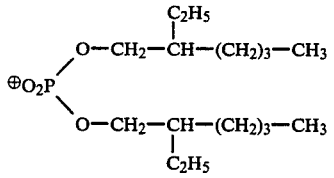

Preferred anions correspond to the following formulae:

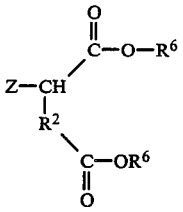

IX

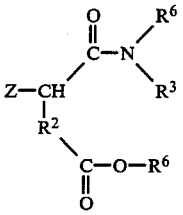

X

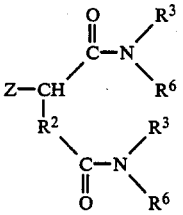

XI in which

Z is one of the groups $-SO_3\ominus$ or

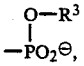

$R^2$ and $R^3$ each represent a $C_1$–$C_{18}$ hydrocarbon radical and $R^6$ is a $C_6$–$C_{24}$ hydrocarbon radical.

The preferred anions corresponding to the above general formulae include, for example, the following:

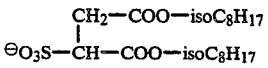

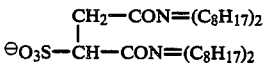

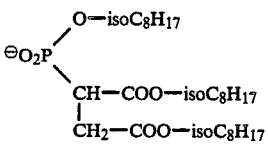

-continued

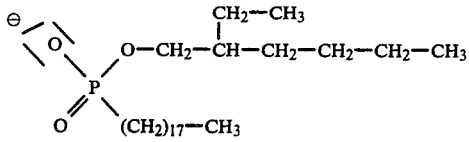

Preferred anions derived from CH-acidic compounds correspond to the following formulae:

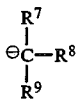

XII

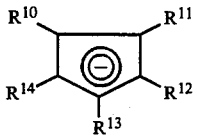

XIII in which $R^7$ is one of the groups $-COOR^6$ or $-SO_2R^6$ where $R^6$ is a $C_6$–$C_{24}$ hydrocarbon radical, $R^8$ and $R^9$ may be the same or different and represent —CN, $-NO_2$, halogen, —COOR or $-SO_2R$, $R^{10}$ is a $C_6$–$C_{24}$ hydrocarbon radical or $-COOR^6$, $R^{11}$ is one of the groups —CN or COOR and $R^{12}$, $R^{13}$ and $R^{14}$ may be the same or different and represent a hydrogen atom or the groups —CN, —R or —COOR, R is a $C_1$–$C_{24}$ hydrocarbon radical.

The following are examples of anions corresponding to these formulae:

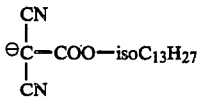

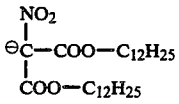

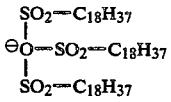

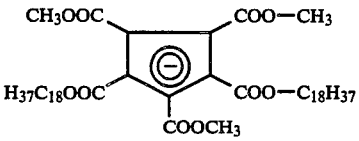

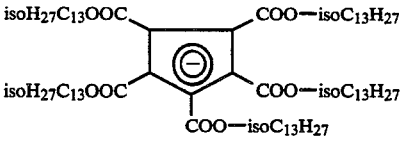

Table I below shows examples of suitable ionic monomers:

TABLE I

| No. | Ionic monomers Formula | |
|---|---|---|
| 1 | $CH_2{=}C(H)-C(=O)-O-CH_2-CH_2-N^{\oplus}(C_2H_5)_2-H$ | $^{\ominus}O_3S-CH(CH_2-C(=O)-O-isoC_8H_{17})-C(=O)-O-isoC_8H_{17}$ |
| 2 | $CH_2{=}C(H)-C(=O)-O-CH_2-CH_2-N^{\oplus}(C_2H_5)_2-H$ | $^{\ominus}O-P(=O)(O-CH_3)-CH(CH_2-C(=O)-O-isoC_8H_{17})-C(=O)-O-isoC_8H_{17}$ |
| 3 | $CH_2{=}C(H)-C(=O)-O-CH_2-CH_2-N^{\oplus}(C_2H_5)_2-H$ | $^{\ominus}O-P(=O)(=O-iso-C_8H_{17})-CH(CH_2-C(=O)-O-isoC_8H_{17})-C(=O)-O-isoC_8H_{17}$ |
| 4 | $CH_2{=}C(CH_3)-C(=O)-O-CH_2-CH_2-N^{\oplus}(CH_3)_2-CH_3$ | $^{\ominus}O_3S-CH(CH_2-C(=O)-O-isoC_8H_{17})-C(=O)-O-isoC_8H_{17}$ |
| 5 | $CH_2{=}C(CH_3)-C(=O)-O-CH_2-CH_2-N^{\oplus}(CH_3)_2-CH_3$ | $^{\ominus}O-P(=O)(O-isoC_8H_{17})(O-isoC_8H_{17})$ |
| 6 | $CH_2{=}C(H)-C(=O)-N(H)-CH_2-CH_2-CH_2^{\oplus}-N(CH_3)_2-CH_2-C_6H_5$ | $^{\ominus}O-P(=O)(O-CH_3)-CH(CH_2-C(=O)-O-isoC_8H_{17})-C(=O)-O-isoC_8H_{17}$ |
| 7 | $CH_2{=}C(CH_3)-C(=O)-O-CH_2-CH_2^{\oplus}-N(CH_3)_2-CH_2-C_6H_5$ | $^{\ominus}O_3S-CH(CH_2-C(=O)-O-isoC_8H_{17})-C(=O)-O-isoC_8H_{17}$ |
| 8 | $CH_2{=}C(CH_3)-C(=O)-O-CH_2-CH_2^{\oplus}-N(CH_3)_2-CH_2-C_6H_5$ | $^{\ominus}C(-SO_2-C_{12}H_{25})_3$ |
| 9 | $CH_2{=}C(CH_3)-C(=O)-O-CH_2-CH_2-N^{\oplus}(CH_3)_2-H$ | 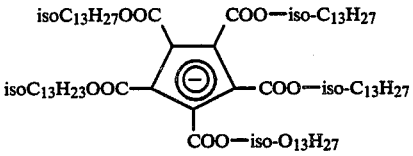 |
| 10 | $CH_2{=}C(CH_3)-C(=O)-O-CH_2CH_2-N^{\oplus}(CH_3)_2-CH_2-C_6H_5$ | $^{\ominus}C(CN)_2-COOiso-C_{10}H_{21}$ |

The ionic monomers are produced from starting compounds known per se.

If the ionic monomers are cationic monomers in which the substituent $R^5$ is a hydrogen atom, the ionic compound may be directly synthesized by an acid-base reaction.

In this connection, it has proved to be particularly advantageous to react the base of the cation with an equivalent quantity of an alkali salt of the desired anion in the presence of an equivalent quantity of a mineral acid, such as sulfuric acid, in aqueous solution. The ionic monomer may be recovered from this aqueous reaction mixture in highly pure form by extraction, toluene, isobutanol and mixtures of these two solvents being particularly suitable extractants.

The synthesis of quaternized compounds is generally carried out in two stages. In the first stage, the N-, P- or S-compound on which the cation is based is quaternized by known methods.

The quaternization reaction is preferably carried out at 0° to 90° C. in the presence of organic solvents. It is best to add polymerization inhibitors known per se, such as for example hydroquinone, hydroquinone monomethyl ether or 2,6-di-tert.-butyl-p-methylphenol, in this stage.

In a second stage, the quaternized compound is reacted with an alkali salt of the desired anion in aqueous solution. The ionic monomers may again be isolated with advantage by extraction using the above-mentioned solvents.

The copolymers may be produced by known radical polymerization processes using the ionic monomers. However, it is also possible initially to prepare a copolymer containing the basic groups on which the cationic part is based and then to introduce the ionic groups by protonation or quaternization, optionally followed by anion exchange.

The copolymers are preferably synthesized by radical polymerization of the ionic monomers. Polymerization may be initiated by standard radical formers, such as peroxides and preferably azo compounds. Redox polymerization, for example using a peroxide/amine system, or photopolymerization are also possible.

Suitable comonomers (B) are, in principle, any radically polymerizable, olefinically unsaturated compounds, more particularly the known vinyl and vinylidene compounds. Examples of suitable comonomers (B) are (meth)acrylic acid and its derivatives, for example (meth)acrylic acid esters containing $C_1$–$C_{24}$ hydrocarbon radicals in the alcohol part, (meth)acrylamide, (meth)acrylonitrile, vinyl esters such as vinyl acetate, vinyl propionate, aromatic vinyl compounds, such as styrene or α-methylstyrene, dienes, such as butadiene and isoprene, and halogen-containing monomers, such as vinyl chloride and vinylidene chloride. Preferred comonomers are (meth)acrylates containing at least one $C_1$–$C_{24}$ hydrocarbon radical in the alcohol part and styrene. Mixtures of different monomers are also suitable. High incorporation levels are obtained above all when (meth)acrylates are used at least partly as comonomers. Both uncrosslinked copolymers and also copolymers crosslinked by using polyfunctional monomers, such as for example ethylene dimethacrylate or divinyl benzene, may be synthesized.

Improved dispersant properties may be imparted to the copolymer through the choice of the comonomers (B). In that case, the copolymer not only charges the dispersed pigment, it also increases the dispersion stability of the pigment dispersion by steric screening. Comonomers which improve the dispersant properties of the copolymer are, for example, vinyl or vinylidene monomers containing a $C_6$–$C_{24}$ hydrocarbon radical, more particularly (meth)acrylates containing $C_6$–$C_{24}$ hydrocarbon radicals in the alcohol part, for example stearyl methacrylate, lauryl methacrylate or 2-ethylhexyl methacrylate, these comonomers preferably being used in quantities of from 10 to 70% by weight (based on copolymer). In this case, it is of advantage to combine the comonomers mentioned here with comonomers containing $C_1$–$C_5$ hydrocarbon radicals.

However, improved dispersant properties of the comonomer are not characteristic of the present invention. It is also readily possible to stabilize the dispersion by adding other polymers, as explained hereinafter.

The copolymer may be synthesized by known methods, such as mass, solution, precipitation, suspension or emulsion polymerization, in the absence of the pigment.

In one preferred embodiment, the copolymer is synthesized in the presence of the dispersed pigment, in which case the copolymer formed enters at least partly into a firm physical or chemical bond with the pigment. In this synthesis process, the pigment is used in the form of a non-aqueous, 0.5 to 40% by weight dispersion. Suitable dispersion media are, primarily, aromatic and aliphatic hydrocarbons, such as for example benzene, toluene, xylene, linear and branched $C_6$–$C_{15}$ alkanes, cyclohexane or decalin.

Polymerization is preferably carried out by a process in which the ionic monomer and comonomer are added to the pigment dispersion, which may optionally contain a stabilizer, and polymerization is started by means of a radical former as initiating component.

The stabilizers used may be soluble, high molecular weight compounds, such as homopolymers or copolymers of (meth)acrylates, for example a 1:1 copolymer of isobutyl methacrylate and lauryl methacrylate. Other suitable stabilizers are copolymers containing from 0.1 to 10% by weight of copolymerized monomers containing —OH, —COOH, —$NH_2$, —NHR and —$NR_2$ groups, such as for example 2-hydroxyethyl methacrylate, (meth)acrylic acid, (meth)acrylamide, N,N-dimethylacrylamide, N,N-dimethylaminoethyl methacrylate and N-vinyl pyrrolidone.

Particularly suitable stabilizers are block copolymers, for example styrene-stearyl methacrylate block copolymers or mercaptan-modified styrene-butadiene block copolymers (DE-A No. 34 12 085).

The polymerization reaction may be carried out by a batch process. In that case, the monomers and the initiating component are added all at once to the pigment dispersion and the reaction is initiated by increasing the temperature. A substantially uniform polymer shell is formed in this way.

In one particularly preferred embodiment, the monomers and the initiating components are introduced during the polymerization reaction (continuous feed process). This embodiment opens up numerous possibilities of particular commercial interest. For example, the monomer composition may be modified over the input period to obtain special effects. Thus, it has proved to be favorable to add the suitable comonomers mentioned above without the ionic monomers at the beginning of the input period and only to add the ionic monomers in admixture with other comonomers after the polymerization reaction has reached a conversion of from 10 to 50%.

The initiating component is also added with advantage over the reaction period. Solid initiating components are best dissolved in solvents or monomers. The copolymer is used in quantities of from 10 to 300% by weight and preferably in quantities of from 10 to 100% by weight, based on pigment.

In addition to the copolymer, other polymeric additives may be used in the production of the suspension developer according to the invention, for example to increase the stability of the dispersion or to improve the adhesion and fixing properties of the dispersed pigment.

The stabilizers mentioned above based on soluble high molecular weight compounds are particularly suitable for increasing the stability of the dispersion.

Suitable fixing agents are resins that are compatible with the binder of the photoconductive recording material, for example with the binder of a photoconductive zinc oxide layer, so that firm adhesion of the image produced to the substrate is obtained after development. Examples of suitable resins are esters of hydrogenated rosin and fatty (long-oil) oil varnish, rosin-modified phenol-formaldehyde resin, pentaerythritol esters of rosin, glycerol esters of hydrogenated rosin, ethyl cellulose, various alkyd resins, polyacrylic and polymethacrylic resin, polystyrene, polyketone resin and polyvinyl acetate. Specific examples of resins of the type in question may be found in the literature on electrostatographic suspension developers, for example in BE-PS No. 699 157 and in GB-A No. 1 151 141.

The suspension developers according to the invention may be produced by standard dispersion processes. Favorable results are obtained using ball mills, bead mills, colloid mills and high-speed stirrers. In this connection, it can be of advantage initially to prepare a mixture of the pigment, the polymer and the other polymeric additives, for example by melting in a kneader, and then to disperse the mixture thus formed in the carrier liquid in a second process step.

Where the above-described polymerization process is carried out in the presence of the pigment, a stable dispersion is in general directly obtained, so that there is no need for an additional dispersion step. It is best initially to prepare a toner concentrate of the carrier liquid, pigment and polymer having a solids content of from 5 to 50% by weight and preferably from 10 to 25% by weight which is diluted by the addition of more carrier liquid to the in-use concentration of from 0.05 to 2% and preferably from 0.1 to 1%.

The following Examples illustrate the synthesis of ionic monomers, the production of the copolymers and also the production and testing of suspension developers according to the invention.

EXAMPLE 1

Production of an ionic monomer (Compound 1 in Table I)

17.1 g of N,N-diethylaminoethyl acrylate are dissolved in 100 ml of deionized water and 100 ml of 1N HCl and 50 mg of hydroquinone added to the resulting solution. 59.2 g of sulfosuccinic acid diisooctyl ester, Na salt, are then added with stirring at room temperature. The ionic monomer formed is extracted with 100 ml of a mixture of equal parts of isobutanol and toluene and isolated by evaporation of the solvent. Yield: 85%.

EXAMPLE 2

Production of an ionic monomer (Compound 9 in Table I)

20.0 g (100 mmoles) or isotridecyl alcohol are added to 7.13 g (20 mmoles) of 1,2,3,4,5-pentamethoxy carbonyl cyclopentadiene. 3.12 g (97.5% of the theoretical) of methanol are distilled off over a period of 8 hours at 100° C., first at 1013 mbar and then at 363—18 mbar. 24 g of 1,2,3,4,5-pentaisotridecyloxycarbonyl cyclopentadiene are obtained.

4.79 g (4 mmoles) of 1,2,3,4,5-pentaisotridecyloxycarbonyl cyclopentadiene are thoroughly mixed with 0.66 g (4 mmoles) of dimethylaminoethyl methacrylate.

2-methacryloxyethyl dimethylammonium-1,2,3,4,5-pentaisotridecyloxycarbonyl cyclopentadienide is formed in an exothermic reaction as a green oil; 5.45 g (quantitative).

EXAMPLE 3

Production of an ionic monomer (Compound 10 in Table I)

19.5 g (88.3 mmoles) of chloroformic acid isodecyl ester in 20 ml of diethylether are added dropwise over a period of 30 minutes at −10° C. to 15.0 g (170 mmoles) of sodium malodinitrile in 150 ml of absolute ethanol. The mixture is then heated to room temperature, followed by refluxing for 30 minutes (68° C.). The deposit of 5.7 g of NaCl (theoretical 5.1 g) is filtered off and the filtrate is concentrated to dryness. Methylene chloride is added to the residue (26.8 g) to dissolve out malodinitrile, followed by filtration under suction and repeated washing with methylene chloride. The deposit is dried in an oil pump vacuum, giving 19.5 g (81% of the theoretical) of sodium dicyanoacetic acid isodecyl ester.

4.95 g (15 mmoles) of benzyl-2-methacryloxyethyl dimethylammonium chloride in 20 ml of water are added to 4.1 g (15 mmoles) of Na dicyanoacetic acid isodecyl ester dissolved in 20 ml of water. A brown-green oil precipitates immediately and is extracted with methylene chloride. The organic phase is dried over sodium sulfate, filtered and methylene chloride is evaporated off with nitrogen. The yield of benzyl-2-methacryloxyethyl dimethylammonium dicyanoacetic acid isodecyl ester comprises 5.9 g (70% of the theoretical).

EXAMPLE 4

Production of a copolymer 2 g of the ionic monomer of Example 2, 9 g of styrene, 9 g of lauryl methacrylate and 20 mg of azodiisobutyrodinitrile are dissolved in 20 g of toluene and the resulting solution stirred for 6 hours at 80° C. The polymer formed is isolated by precipitation with methanol and purified by dissolution and reprecipitation. Yield: 14 g, [$\eta$]: 0.62 dl/g in toluene at 25° C.

EXAMPLE 5

Production of a copolymer

A copolymer is produced as in Example 4 from 2 g of the ionic monomer of Example 3, 9 g of styrene and 9 g of lauryl methacrylate. Yield: 15 g, [$\eta$]: 0.72 dl/g in toluene at 25° C.

EXAMPLE 6

Production of a suspension developer according to the invention 5 g of isododecane are added to 5 g of the copolymer of Example 4 and 5 g of carbon black pigment (BET surface 30 $m^2/g$), followed by grinding for 10 hours in a ball mill. The developer concentrate obtained is diluted with isododecane to a concentration by weight of 0.4% by weight.

The charging and charge stability of the dispersed pigment particles (toner particles) was tested as follows:

The suspension developer is introduced into an electrophoresis cell comprising 2 planar electrodes separated by a gap of 0.15 cm and each having a surface area of 20 $cm^2$. The electrical current produced by applying a voltage of 500 V for 0.5 s is measured. The integral of the current over the time of 0.5 s is the $Q_T$-value. $Q_T$ is a measure of the charging of the toner particles.

The deposition of the toner particles (blackening) on the negative electrode (cathode) shows that they are positively charged. The charge stability of the toner particles was tested by measuring the value $Q_{T1}$ immediately after preparation of the liquid developer and the value $Q_{T2}$ after 7 days' storage:

$Q_{T1}$: $+4 \cdot 10^{-8}$C $Q_{T2}$ $+5 \cdot 10^{-8}$C

EXAMPLE 7

Production of a suspension developer according to the invention

The procedure was as in Example 6 using 5 g of the copolymer of Example 5 and 5 g of carbon black pigment (BET surface 90 $m^2/g$:

$Q_{T1}$: $+6 \cdot 10^{-8}$C $Q_{T2}$: $+5 \cdot 10^{-8}$C

EXAMPLE 8

Production of a suspension developer according to the invention 20 g of a copolymer of equal parts of lauryl methacrylate and isobutyl methacrylate having a molecular weight of 120,000 are added to 80 g of carbon black pigment (BET surface 30 $m^2/g$), followed by dispersion in 100 g of isododecane using a ball mill.

250 g of the dispersion obtained are transferred to a stirrer-equipped reactor and heated to 80° C. First 250 mg of azoisobutyrodinitrile are added with stirring, followed immediately afterwards by the uniform addition over a period of 60 minutes of a solution of 75 g of toluene, 7.5 g of lauryl methacrylate, 7.5 g of isobutylmethacrylate, 5 g of divinyl benzene, 5 g of the ionic monomer of Example 1 and 100 mg of azoisobutyrodinitrile. On completion of the addition, the dispersion is stirred for 1 hour at 80° C. and then for 3 hours at 90° C.

For purification, the dispersion is centrifuged in a bucket centrifuge. The solid formed is isolated and redispersed in 250 g of pure isododecane using a shaker. This operation is repeated once. The dispersion is then adjusted to a solids content of 0.4% by weight by the addition of more isododecane and tested:

$Q_{T1}$: $+5 \cdot 10^{-8}$C $Q_{T2}$: $+6 \cdot 10^{-8}$C average particle size: 314 nm.

EXAMPLE 9

Production of a suspension developer according to the invention 40 g of the pigment Helioechtblau HG (C.I. No. 74 160) and 40 g of the copolymer described in Example 8 are dispersed in 320 g of isododecane in a ball mill.

100 g of the dispersion obtained are diluted with 150 g of isododecane, transferred to a stirrer-equipped reactor and heated to 80° C. First 250 mg of azoisobutyrodinitrile are added with stirring, followed by the uniform addition over a period of 30 minutes of solution I.

Solution I

| |
|---|
| 40 g of toluene |
| 2 g of divinyl benzene |
| 8 g of butylacrylate |
| 100 mg of azoisobutyrodinitrile |

Immediately after solution I has been added, solution II is introduced.

Solution II

| |
|---|
| 40 g of toluene |
| 0.5 g of divinyl benzene |
| 1 g of the ionic monomer of Example 3 |
| 8.5 g of stearyl methacrylate |
| 100 mg of azoisobutyrodinitrile |

After solution II has been added, the dispersion is stirred for 1 hour at 80° C. and then for 3 hours at 90° C.

For purification, the dispersion is centrifuged in a bucket centrifuge, the solid formed is isolated and then redispersed in 250 g of pure isododecane using a shaker. This operation is repeated once. The dispersion is then adjusted to a solids content of 0.4% by weight by the addition of more isododecane and tested.

$Q_{T1} = +5 \cdot 10^{-8}$C $Q_{T2} = +5 \cdot 10^{-8}$C average particle size: 780 nm.

EXAMPLE 10

The procedure is as in Example 9 using the ionic monomer of Example 2:

$Q_{T1}$: $+8 \cdot 10^{-8}$C $Q_{T2}$: $+8 \cdot 10^{-8}$C

EXAMPLE 11

The procedure is as in Example 5 using the ionic monomer of Example 1:

$Q_{T1}$: $+9 \cdot 10^{-8}$C $Q_{T2}$: $+8 \cdot 10^{-8}$C

EXAMPLE 12

Production of a suspension developer according to the invention 80 g of carbon black pigment (BET surface 95 $m^2/g$) and 20 g of the copolymer described in Example 8 are dispersed in 300 g of isododecane in a ball mill.

250 g of the dispersion obtained are transferred to a stirrer-equipped reactor and heated to 80° C. 250 mg of azoisobutyrodinitrile are added with stirring, followed by the uniform addition over a period of 30 minutes of solution I.

Solution I

| |
|---|
| 43.75 g of toluene |
| 2.5 g of lauryl methacrylate |
| 2.5 g of isobutyl methacrylate |
| 1.25 g of divinyl benzene |
| 50 mg of azoisobutyrodinitrile |

Immediately after solution I has been added, solution II is introduced.

Solution II

| | |
|---|---|
| 43.75 | g of toluene |
| 1.25 | g of lauryl methacrylate |
| 1.25 | g of isobutyl methacrylate |
| 1.25 | g of divinyl benzene |
| 2.5 | g of the ionic monomer of Example 1 |

After solution II has been added, the dispersion is stirred for 1 hour at 80° C. and then for 3 hours at 90° C.

For purification, the dispersion is centrifuged in a bucket centrifuge, the solid formed is isolated and then redispersed in 300 g of pure isododecane. This operation is repeated once. The dispersion is then adjusted to a solids content of 0.4% by the addition of more isododecane and tested.

$Q_{T1}$: $+15 \cdot 10^{-8}$C $Q_{T2}$: $+16 \cdot 10^{-8}$C average particle size: 85 nm.

EXAMPLE 13

Comparison with the positively polarizing agent according to GB-A No. 1 151 141

A dispersion is prepared in a ball mill from 4 g of carbon black pigment (BET surface 30 $m^2/g$), 1 g of a copolymer of 85% of isobutyl methacrylate and 15% of stearyl methacrylate (molecular weight Mw 170,000) and 45 g of isododecane. The dispersion is diluted to a solids content of 0.4% and, after the addition of 80 mg of zinc (2-butyl)-octyl phosphate (prepared in accordance with GB-PS No. 1 151 141), is tested:

$Q_{T1}$: $+23 \cdot 10^{-8}$C $Q_{T2}$: $+12 \cdot 10^{-8}$C

EXAMPLE 14

Conductivity measurements

The conductivity of the developer as a whole ($H_E$) and the conductivity of the carrier liquid of the developer ($H_M$) after separation of the pigment particles by centrifuging was determined by the method described by Kohler et al. in Photographic Science and Engineering 22, 4 (1978) 218-227.

| Suspension developer | $H_E$ [$ohm^{-1}m^{-1}$] | $H_M$ [$ohm^{-1}m^{-1}$] |
|---|---|---|
| Example 11 | $2.0 \cdot 10^{-10}$ | O* |
| Example 12 | $9.3 \cdot 10^{-10}$ | O* |
| Example 13 (Comparison) | $4.6 \cdot 10^{-10}$ | $1.1 \cdot 10^{-10}$ |

*The detection limit of the measuring apparatus is at $10^{-12}$ [$ohm^{-1}$ $m^{-1}$]

The Table shows that the suspension developers according to the invention do not have the conductivity of the carrier liquid.

We claim:

1. An electrostatographic suspension developer containing a dispersed pigment and at least one ionic copolymer to produce a positive toner charge in an electrically insulating carrier liquid having a volume resistivity of at least $10^9$ ohm.cm and a dielectric constant below 3, characterized in that the copolymer is formed from cationic monomers in which the cations of the monomers correspond to the following general formulae

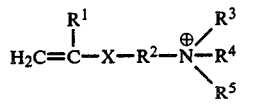
I

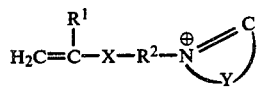
II

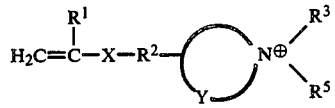
III

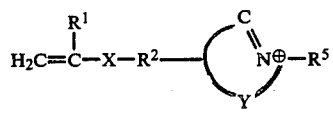
IV

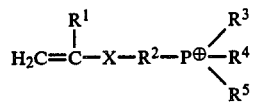
V

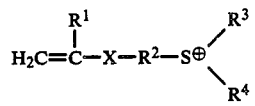
VI in which $R^1$ is a hydrogen atom or a $CH_3$-group, $R^2$ is a $C_1$–$C_{18}$ hydrocarbon radical, $R^3$ and $R^4$ may be the same or different and represent a $C_1$–$C_{18}$ hydrocarbon radical or together form a 5- or 6-membered ring, $R^5$ is a hydrogen atom or a $C_1$–$C_{18}$ hydrocarbon radical, X is one of the groups

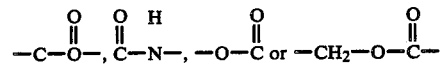

and

Y represents the atoms required to complete a 5- or 6-membered heterocyclic ring, and the anions of the cationic compounds correspond to the following general formulae

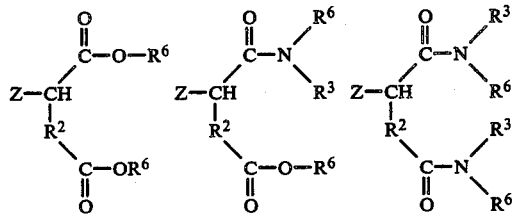
IX X XI

-continued

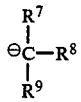

XII

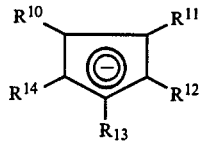

XIII in which

Z is one of the groups $—SO_3^{o}$ or $$—\overset{\overset{\displaystyle OR^3}{|}}{P}O_2,$$

$R^2$ and $R^3$ each represent a $C_1$–$C_{18}$ hydrocarbon radical $R^6$ is a $C_6$–$C_{24}$ hydrocarbon radical, $R^7$ is one of the groups $—COOR^6$ or $—SO_2R^6$, $R^8$ and $R^9$ may be the same or different and represent one of the groups —CN, $—CO_2$, —halogen, —COOR or $—SO_2R$, $R^{10}$ has the same meaning as $R^6$ or is a $—COOR^6$ group, $R^{11}$ is one of the groups —CN or —COOR and $R^{12}$, $R^{13}$ and $R^{14}$ may be the same or different and represent a hydrogen atom or the groups —CN, —R or —COOR, R is a $C_1$–$C_{24}$ hydrocarbon radical.

2. A suspension developer as claimed in claim 1 characterized in that the comonomers (B) are vinyl or vinylidene compounds from the group comprising (meth)acrylates containing $C_1$–$C_{24}$ hydrocarbon radicals in the alcohol part, (meth)acrylamide, (meth)acrylonitrile, vinyl acetate, vinyl propionate, styrene, α-methyl styrene, butadiene, isoprene, vinyl chloride, vinylidene chloride, ethylene dimethacrylate, divinyl benzene, stearyl methacrylate, lauryl methacrylate and 2-ethylhexyl methacrylate.

3. A suspension developer as claimed in claim 2, characterized in that the comonomer (B) consists partly of a (meth)-acrylate containing from 6 to 24 carbon atoms in the alcohol part.

4. A suspension developer as claimed in claim 1, characterized in that the copolymer contains from 0.1 to 80% by weight and preferably from 0.5 to 50% by weight of the monomers (A).

5. A process for producing the electrostatographic suspension developer claimed in claim 1, characterized in that the monomers (A) and the comonomers (B) are polymerized in the presence of the pigment in an aliphatic or aromatic hydrocarbon having the properties of the carrier liquid as dispersion medium and a dispersion containing the pigmented copolymer suitable for use as a suspension developer is formed in this way.

6. A process as claimed in claim 5, characterized in that the monomers (A) and (B) are added to a dispersion of the pigment in the dispersion medium by a continuous feed process in which only the comonomers (B) are added in a first polymerization phase, the monomers (A) being added in admixture with more of the comonomers (B) in a second polymerization phase.

7. A process as claimed in claims 5 or 6, characterized in that the hydrocarbon used as dispersion medium contains a styrene-stearyl methacrylate or mercaptan-modified styrenebutadiene block polymer as stabilizer.

* * * * *